United States Patent [19]

Bleich

[11] Patent Number: 4,754,133

[45] Date of Patent: Jun. 28, 1988

[54] TRANSCEIVER CIRCUIT FOR MODULATED INFRARED SIGNALS

[75] Inventor: Charles R. Bleich, Palatine, Ill.

[73] Assignee: Williams Electronics Games, Inc., Chicago, Ill.

[21] Appl. No.: 856,298

[22] Filed: Apr. 25, 1986

[51] Int. Cl.[4] ..... G01V 9/04; G06M 7/00; H01J 40/19

[52] U.S. Cl. ..... 250/221; 273/311; 455/603

[58] Field of Search ..... 273/311; 434/22; 250/221, 222.2, 214, 338, 340; 455/619, 605, 603, 617; 340/540

[56] References Cited

U.S. PATENT DOCUMENTS

| | | | |
|---|---|---|---|
| 2,457,502 | 12/1948 | Shepherd | 455/603 |
| 3,104,478 | 9/1963 | Strauss et al. | 35/25 |
| 3,434,226 | 3/1969 | Shaller | 273/311 |
| 3,499,650 | 3/1970 | Lemelson | 273/101.1 |
| 3,534,351 | 10/1970 | Harnden, Jr. et al. | 455/603 |
| 3,655,192 | 4/1972 | Hall et al. | 273/101.1 |
| 3,792,535 | 2/1974 | Marshall et al. | 35/25 |
| 3,894,229 | 7/1975 | Mouri | 455/603 |
| 3,928,760 | 12/1975 | Isoda | 455/603 |
| 3,936,822 | 2/1976 | Hirschberg | 340/540 |
| 3,938,262 | 2/1976 | Dye et al. | 35/25 |
| 4,063,368 | 12/1977 | McFarland et al. | 434/22 |
| 4,150,824 | 4/1979 | Villa | 273/101.1 |
| 4,257,612 | 3/1981 | Villa | 273/310 |
| 4,349,337 | 9/1982 | Pardes | 434/22 |
| 4,352,665 | 10/1982 | Kimble et al. | 434/22 |
| 4,487,583 | 12/1984 | Brucker et al. | 273/311 |
| 4,561,849 | 12/1985 | Eichweber | 434/22 |
| 4,629,427 | 12/1986 | Gallagher | 273/311 |

OTHER PUBLICATIONS

Brochure Simulaser Corp., "Combat Training System with Player Identification".

Instruction manual, Fair Toy Corporation Device.

*Primary Examiner*—David C. Nelms

*Assistant Examiner*—William L. Oen

*Attorney, Agent, or Firm*—Jones, Day, Reavis & Pogue

[57] ABSTRACT

An infrared transceiver circuit for a toy gun or other novelty item includes an IR detector, a high Q band pass filter and a demodulator in the receiver section to control the operation of a counter which, in turn, actuates lights and sounds when a "hit" is detected. The transmitter portion generates an IR signal modulated by an oscillator and square wave generator. The high Q band pass circuit substantially eliminates unmodulated infrared as, for example, from sunlight, to increase receiver sensitivity.

14 Claims, 2 Drawing Sheets

TRANSCEIVER CIRCUIT FOR MODULATED INFRARED SIGNALS

BACKGROUND OF THE INVENTION

The present invention relates to IR transceiver circuits. More specifically it relates to low cost transceiver circuits which are suitable for use in toys, such as toy guns, toy robots, cars, targets, helmets and similar items. Typically a pair of such toys are similarly equipped, as for example a pair of toy guns, so that one user can "shoot" at another user. The first person to shoot will send a modulated IR signal to the receiver of the other toy gun. The signal will be detected and an indication made that the first person has scored a hit. Other applications of such a circuit include the remote control of toy devices, such as robots, toy cars, or even devices such as televisions, radios or other equipment.

Infrared transmitters and receivers are known in the art as, for example, the well known infrared transmitter/receiver combinations employed in television receivers. Such circuits perform reliably under controlled conditions inside a home. When intended for use in toys, however, it is desirable that the transceiver circuits operate outdoors as well as in the home. Under these circumstnces, most existing transceiver circuits do not operate reliably due to ambient infrared radiation. Such radiation, principally due to sunlight, is unmodulated. Typically, the IR detectors of the receivers become saturated by the ambient IR, severely reducing the sensitivity of the circuit to modulated IR signals.

It is accordingly an object of the present invention to provide an improved transceiver circuit for toy guns and the like which is capable of operating under more severe conditions than conventional circuitry.

It is a further object of the invention to provide a low cost, reliable IR transceiver circuit for use in toys and related electronic equipment.

Another object of the invention is to provide a filter circuit for an IR receiver whereby good sensitivity to a modulated signal can be maintained even in the presence of ambient, unmodulated IR interference.

Other objects and advantages of the invention will be apparent from the remaining portion of the specification.

DETAILED DESCRIPTION

Figure 1:
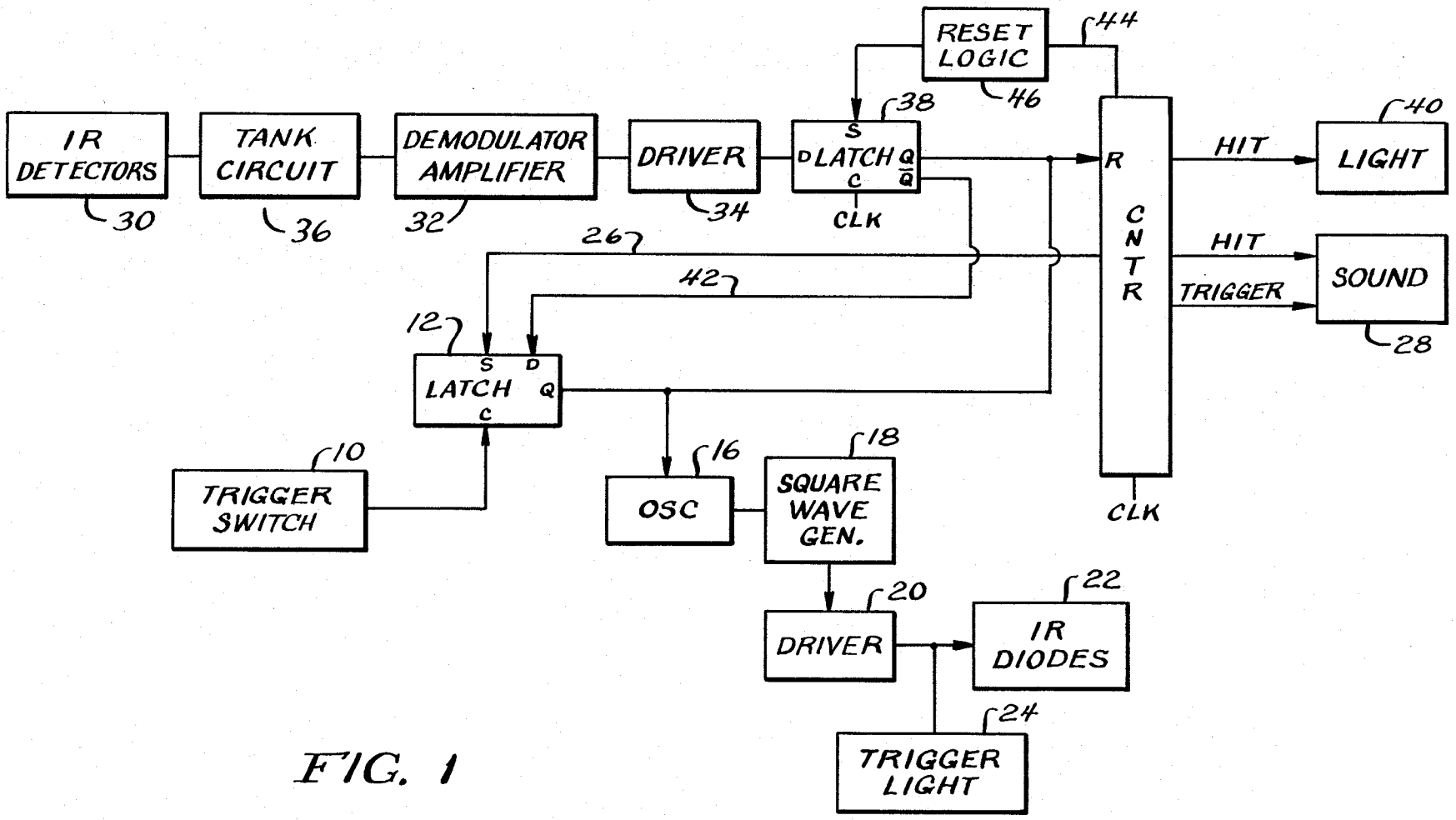
FIG. 1 is a block diagram of the IR transceiver circuit according to a preferred embodiment of the invention.

Referring to FIG. 1, the transceiver circuit is shown in block diagram form. For ease of description the circuit may be divided into a transmitter portion and a receiver portion.

TRANSMITTER PORTION

The transmitter is controlled by a switch 10 which, in the case of a toy gun, may take the form of a trigger switch. Closing switch 10 clocks a D type latch 12 clearing its Q output. The output is connected to the reset input of a binary counter 14. Clearing the latch removes the reset signal permitting the counter to begin operation.

Clearing latch 12 also enables operation of an oscillator 16 which is preferably a type 555 timer operating at a frequency of 80K hertz. Oscillator 16 is used to modulate the IR signal to be produced. The output of the oscillator is provided to a square wave generator 18 (preferably a flipflop) to produce a 50% duty cycle at a frequency of 40K hertz. The output of the square wave generator is provided to a driver circuit 20 which is fed to infrared diodes 22 to produce the modulated infrared signal. If desired, the driver may also operate a small wattage light bulb 24. Thus, each time the trigger 10 is actuated the latch 12 is cleared causing the oscillator to produce a modulated IR signal.

The counter 14 permits operation of the modulator portion of the circuit for a predetermined time period which may easily be programmed. When the desired count is reached a signal from the corresponding output of the counter is generated on line 26 which sets the latch 12, disabling the counter and oscillator and terminating transmission of the IR signal. During operation of the counter in the transmit mode, a sound generator circuit 28 of conventional design may be enabled to create "firing sounds".

Operation of the counter 14 is under the control of a clock oscillator 30 of conventional design. The counter itself may be any of a number of commercially available programmable counters as, for example, an Intel 4020 14 bit binary counter.

Receiver Portion

Referring to the upper portion of FIG. 1, the receiver portion of the circuit is illustrated. A set of IR detectors 30 are provided. Preferably there are at least three such detectors so that reception may be more nearly omnidirectional. This adds realism, in the case of a toy gun, by permitting the detection of a hit regardless of the position of the gun relative to the transmitter of the other gun. A typical arrangement includes one detector positioned forward with additional detectors for the left and right sides. The output of the IR detectors is processed by a demodulator/amplifier circuit 32. This circuit is commercially available from Motorola under part No. MC3373. This circuit will react to a signal of a specific frequency as determined by a tuning circuit cooperating therewith, demodulate and amplify the signal and provide it to the driver circuit 34. Operatively connected to the input side of the demodulator 32 is a high Q band pass circuit 36 which provides significantly improved sensitivity to the receiver when the device is utilized out of doors or otherwise in the presence of ambient, unmodulated infrared frequency interference. The details of this circuit are explained in connection with FIG. 2.

The output of the demodulator/amplifier 32 is provided to a driver 34 and, in turn, to the D input of a latch 38 which is clocked by oscillator circuit 30. The latch 38 removes the reset signal from the counter 14 initiating its operation. In this mode the counter again may operate a sound circuit 28, preferably producing a different sound than the trigger sound, and, if desired, a hit light 40. During the period when the latch 38 is operational it is desired to inhibit the ability to operate the trigger switch 10. This is to prevent the possibility of feedback from the transmitter to the detector of the same circuit and to "penalize" the player who has been hit by inhibiting, temporarily, his ability to fire back at his opponent. This is accomplished by the connection between the $\overline{Q}$output of latch 38 and the D input of latch 12 via line 42. When the $\overline{Q}$signal is high, during receiver operation, the latch 12 does not respond to the trigger switch 10 accomplishing the desired objective.

The counter 14, in the receiver mode, must count long enough to permit the sound and light circuits to operate. Thereafter latch 38 is set via line 44 and gate logic 46 from one or more outputs of the counter. This inhibits counter operation, re-enables the trigger 10 and permits play to continue.

From the foregoing it will be seen that there is disclosed a simple yet effective IR transceiver circuit which can be employed in a pair of toy guns or similar devices for recreational purposes. The circuits will transmit IR to one another and detect the same inhibiting transmission when a valid signal has been detected until the participant has received visual and/or audible indications of a hit.

High Q Tank Circuit

Figure 2:
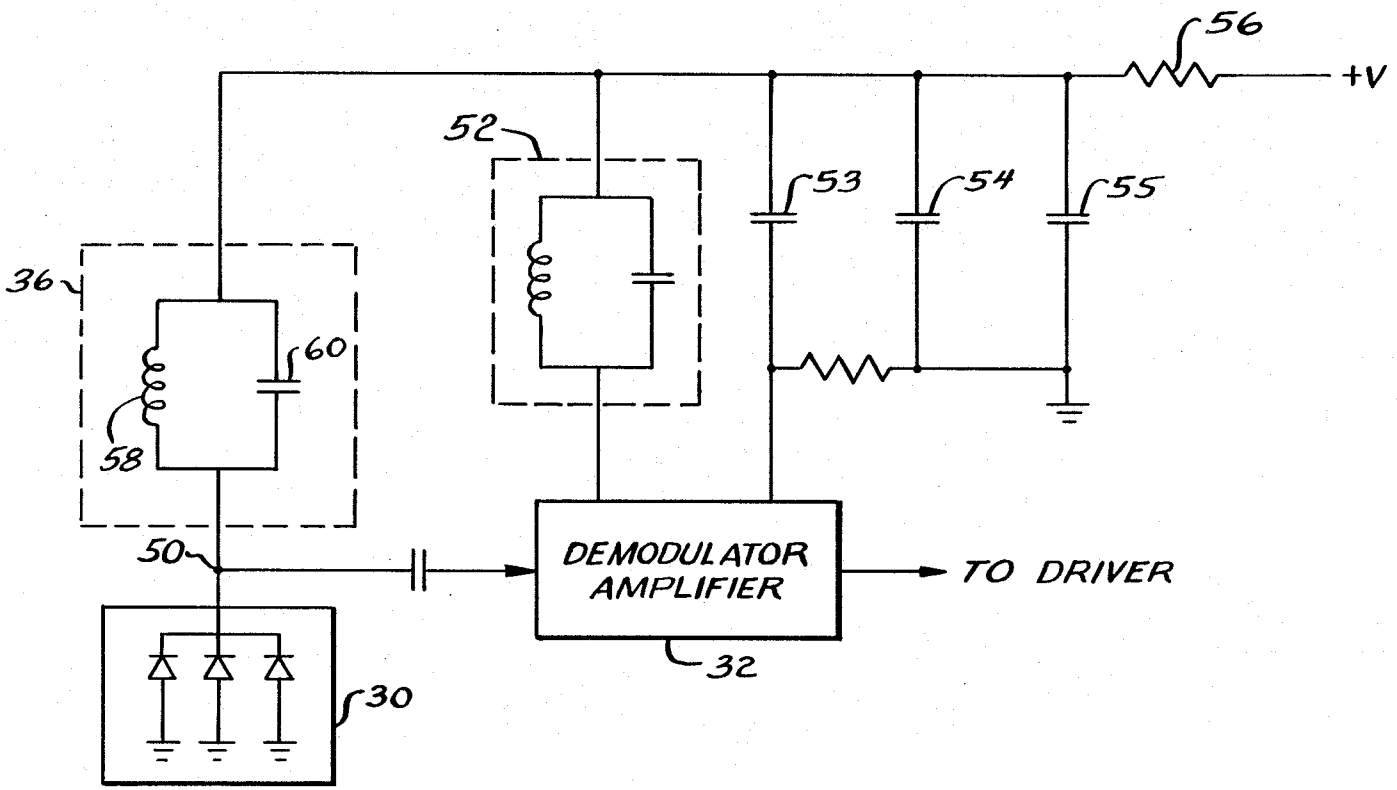
FIG. 2 is a schematic diagram of the receiver portion of the FIG. 1 circuit.

Referring to FIG. 2, an important aspect of the invention is shown in greater detail. As mentioned, the present application, unlike prior devices, is capable of being used both indoors and out of doors where the devices are subject to relatively significant unmodulated infrared interference from the sun and other sources. This result is achieved principally by virtue of the tank circuit 36 operatively connected to the input of the demodulator 32. As shown in FIG. 2, the IR detectors 30 are preferably pin diodes connected in parallel, the outputs of which are provided via terminal 50 to the input of the demodulator circuit 32. The demodulator circuit is itself provided with a tank circuit 52 consisting of a parallel combination of a capacitor and inductor. The values of the elements are selected for the desired modulation frequency to be detected which, in this case, is 40K hertz. The other capacitors 53–55 provided to the circuit 32 provide internal noise immunity for the demodulator to prevent interference from the clock circuit.

The IR detectors 30 change impedance as a function of detected infrared radiation. The greater the detected radiation integrity, the lower the impedance. The demodulator 32 detects the change in current flow due to the impedance drop and, if the modulation frequency received matches the frequency to which the tank circuit 52 is tuned, an output signal is provided for operating the receiver circuit as previously described.

As indicated in the background portion of the specification, however, sunlight deleteriously affects the operation of the system. Sunlight contains sufficient unmodulated infrared radiation to saturate the IR detectors 30 rendering them relatively insensitive to the specific modulated signal to which they are designed to respond. It is necessary, therefore, substantially to eliminate the ambient IR from sunlight and similar sources. This is accomplished, according to the present invention, by preventing the IR detectors from becoming saturated by ambient IR radiation. For that purpose the tank circuit 36 is provided. It is operatively connected between the power supply +V, via a low valve resistor 56, and terminal 50 as shown. The tank circuit 36 includes an inductor 58 and a capacitor 60 having substantially the same values as tank circuit 52 and, therefore, tuned to the same modulation frequency, which in the preferred embodiment, is 40K hertz.

The resistor 56 is provided simply to add additional noise immunity to prevent interference from the clock circuit. When the detector circuit encounters ambient, unmodulated IR, the detectors become essentially low impedance elements unless the current path between the power supply and the diodes has a sufficiently low resistance, current flow will be insufficient to prevent the diodes from becoming saturated. The tank circuit 36, at frequencies other than 40K hertz, appears as a short circuit and the low resistance 56 permits sufficient current flow to prevent saturation from ambient IR. This maintains the detectors out of saturation insuring that they will remain sensitive to a modulated IR signal.

On detecting a 40K hertz modulated signal, however, the tank circuit 36 appears as a high impedance permitting the detectors to signal the demodulator 32. Thus an effective discriminating circuit is provided which ignores unmodulated background infrared while properly detecting modulated infrared of a selected frequency.

Without the tank circuit 36 a series of resistance of at least 1K ohm would be provided between the power supply and the IR detectors. Ambient IR striking the detectors would saturate them because the resistance would limit the current flow to a value less than required to avoid saturation. In sum, the present invention insures that the relatively small signal produced by a transmitter can be detected against a background of unmodulated IR present in the ambient environment. The present invention accomplishes this result with minimum expense and a high degree of reliability by simply preventing saturation of the detectors by ambient IR through the use of a tank circuit 36 which is tuned to the desired frequency to be detected. At all other frequencies the tank circuit appears to be a short circuit permitting adequate current flow to avoid saturation while at the tuned frequency it acts as a high impedance permitting detection of the modulated signal by the demodulator/amplifier 32.

While I have shown and described embodiments of the invention, it will be understood that this description and illustrations are offered merely by way of example, and that the invention is to be limited in scope only as to the appended claims.

What is claimed is:

1. A circuit, including a power supply, for detecting modulated infrared (IR) radiation of a predetermined modulation frequency while rejecting other IR emissions comprising:

(a) at least one means for detecting IR radiation, (b) demodulation means operatively connected to said detecting means and tuned to said predetermined modulation frequency for producing an output signal when IR radiation at said predetermined modulation frequency is detected, (c) means for maintaining the sensitivity of the detecting means to the modulated IR signal of interest even in the presence of substantial background IR radiation includes a tank circuit interposed between said power supply and the detecting means, said tank circuit being tuned to produce a high impedance at said predetermined modulation frequency and a low impedance otherwise, whereby saturation of the detecting means by said background IR radiation is substantially prevented.

2. The circuit of claim 1 further including:

(d) means for transmittrng modulated IR radiation of said predetermined frequency, (e) means for inhibiting said transmitting means for a selected time period when said demodulator means produces said output signal, whereby two or more of said circuits can be employed in spaced relation and each can detect the transmissions of the other circuits but not of its own transmitting means.

3. The circuit of claim 1 wherein the receiver includes three detection means arranged to provide substantially omni-directional reception.

4. The circuit of claim 1 wherein the detector means are semiconductor devices which change impedance as a function of detected IR radiation.

5. The circuit of claim 4 wherein said semiconductor devices are diodes.

6. The circuit according to claim 1 further including timing means and output means, both responsive to said demodulator means output signal, said output means producing an indication that said modulator IR signal has been detected, said timing means initiating and terminating the operation of said output means.

7. The circuit according to claim 6 wherein said output means are audio or visual indicators.

8. The circuit according to claim 6 wherein said timing means includes a counter and logic means for controlling the counting sequence.

9. The circuit of claim 1 wherein said tank circuit is comprised of a parallel combination of an inductor and capacitor, the values of which are selected to resonate at said predetermined modulation frequency thereby to provide a high impedance at said predetermined frequency and a low impedance at other frequencies.

10. The circuit of claim 4 wherein said means for maintaining the semiconductor devices sensitivity is a tank circuit interposed between the power supply and the semiconductor devices, said tank circuit being tuned to produce a high impedance at said predetermined modulation frequency and a low impedance otherwise, whereby saturation of the semiconductor devices by said background IR radiation is substantially prevented.

11. The circuit according to claim 2 wherein said transmitting means includes:

(a) means for generating said modulated IR radiation when enabled, (b) means for enabling said generating means for a predetermined time period.

12. The circuit according to claim 11 wherein said inhibiting means is a two state logic element, said logic element connected to block operation of said enabling means for said selected time period when said output signal is produced.

13. A transceiver circuit, including a power supply, for transmitting to and detecting from other such circuits modulated infrared (IR) radiation of a predetermined modulation frequency comprising:

(a) at least one means for detecting IR radiation, (b) demodulation means operatively connected to said detecting means and tuned to said predetermined modulation fequency for producing an output signal when IR radiation at said predetermined modulation frequency is detected, (c) means for maintaining the sensitivity of the detecting means to the modulated IR signal of interest even in the presence of substantial background IR radiation, said means for maintaining including a tank circuit interposed between said power supply and the detecting means, said tank circuit being tuned to produce a high impedance at said predetermined modulation frequency and a lower impedance otherwise, whereby saturation of the detecting means by said background IR is substantially prevented, (d) means for transmitting modulated IR radiation of said predetermined frequency, (e) means for inhibiting said transmitting means for a selected time period when said demodulator means produces said output signal, whereby two or more of said circuits can be employed in spaced relation and each can detect the transmissions of the other circuits but not of its own transmitting means.

14. The circuit according to claim 13 further including timing means and output means, both responsive to said demodulator means output signal, said output means producing an indication that said modulated IR signal has been detected, said timing means initiating and terminating the operation of said output means.

* * * * *